United States Patent [19]

Drelich et al.

[11] 4,146,417

[45] Mar. 27, 1979

[54] METHOD FOR PRODUCING BONDED NONWOVEN FABRICS USING IONIZING RADIATION

[75] Inventors: Arthur H. Drelich, Plainfield; David G. Oney, Neshanic, both of N.J.

[73] Assignee: Johnson & Johnson, New Brunswick, N.J.

[21] Appl. No.: 833,859

[22] Filed: Sep. 16, 1977

Related U.S. Application Data

[63] Continuation-in-part of Ser. No. 683,102, May 4, 1976, abandoned.

[51] Int. Cl.[2] ..... D04H 1/58

[52] U.S. Cl. ..... 156/62.2; 19/296; 28/122; 156/181; 156/272; 156/305; 156/324; 428/288; 428/290; 428/361

[58] Field of Search ..... 156/272, 181, 324, 306, 156/62.2, 62.4, 62.6, 305, 296; 428/288, 290, 96, 360, 375, 361, 296; 19/145, 296, 304, 308; 28/122

[56] References Cited

U.S. PATENT DOCUMENTS

| | | | |
|---|---|---|---|
| 2,906,317 | 9/1959 | Keyes | 156/62.6 |
| 3,117,055 | 1/1964 | Guandique et al. | 428/290 |
| 3,459,627 | 8/1969 | Vosburgh, Sr. | 156/209 |
| 3,589,956 | 6/1971 | Kranz et al. | 156/62.4 |
| 3,713,927 | 1/1973 | Peterson et al. | 156/62.6 |
| 3,810,816 | 5/1974 | Zachariades | 156/272 X |

*Primary Examiner*—Michael G. Wityshyn
*Attorney, Agent, or Firm*—Charles J. Metz

[57] ABSTRACT

A method for producing a resin-bonded nonwoven fabric comprising forming a fibrous web, compressing the web to provide fiber to fiber contact, applying a polymerizable binder to the fibrous web and treating the web with the binder thereon with ionizing radiation to produce a resin bonded nonwoven fabric.

9 Claims, 3 Drawing Figures

METHOD FOR PRODUCING BONDED NONWOVEN FABRICS USING IONIZING RADIATION

This application is a continuation-in-part of our copending application Ser. No. 683,102, filed May 4, 1976, now abandoned.

This invention relates to improved methods for manufacturing resin-bonded nonwoven fabrics.

In the manufacture of resin-bonded nonwoven fabrics, it is believed important that the fibers be in substantial contact with each other at crossing points when the binder is activated or cured to produce good fiber to fiber adhesion at at least a portion of these crossing points. Without the fibers being in substantial contact, the binder will not encapsulate or surround adjacent fibers and hold them together. This is not usually a problem when binders are applied from water and the water driven off by heat. The surface tension tends to compress the fiber layer and hold fibers together while the binder is being cured and activated.

Recently there have been a number of developments using ionizing radiation to activate binder materials in the bonding of nonwoven fabrics. When trying to bond synthetic fibers using ionizing radiation, it is extremely difficult to hold adjacent fibers in substantial contact with each other while activating the binder. If a solvent, water or pre-binder is used to attempt to hold the fibers together during the ionizing radiation treatment, the water or other additives disrupt and are detrimental to the ionizing radiation treatment. Even if minor amounts of pre-binder materials are used, when applied from liquids, they tend to accumulate at the most desirable areas for bonding because of the capillary action of the liquid and hence even minor amounts greatly undermine the desired ionizing radiation treatment. Mechanical treatments such as compression belts also are unsatisfactory. Although such belts hold fibers in substantial contact during the ionizing radiation treatment, the most desirable areas for bonding are blocked or at least partially blocked during the ionizing radiation. Also, the binder may adhere to the mechanical means and prevent economical processing by such techniques.

We have developed improved techniques for producing resin-bonded nonwoven fabrics using ionizing radiation. In our techniques the fibers are in substantial contact with each other either before, during or after the ionizing radiation and are held in this contact without the addition of deleterious materials which are detrimental to the ionizing radiation treatment.

In accordance with the methods of the present invention, a layer of synthetic fibers is formed. A small amount, that is, up to 5 percent by weight of the layer, of a thermoplastic fiber is incorporated in the layer and the layer heated and compressed to place fibers into intimate contact with adjacent fibers. A polymerizable binder material is applied to the compressed fiber layer and the compressed layer treated with ionizing radiation to polymerize the binder material and adhere the fibers together. In certain of our methods, the polymerizable binder material may be applied to the layer of synthetic fibers and the layer heated and compressed to place fibers into intimate contact without the addition of thermoplastic fiber materials. In these methods the polymerizable binder material has properties similar to the thermoplastic fibers and holds the fibers together. The compressed fiber layer is treated with ionizing radiation to polymerize the binder material and produce a strong nonwoven fabric. In yet other methods we have found that if the correct polymerizable binder materials are placed on the web first and the web treated with ionizing radiation to polymerize the binder, it may thereafter be compressed and the fibers brought into intimate contact with each other. As the binder material continues its polymerization, it will adhere adjacent fibers together to produce strong nonwoven fabrics.

The invention will be more fully described in conjunction with the accompanying drawings wherein.

Figures 1, 2, 3:
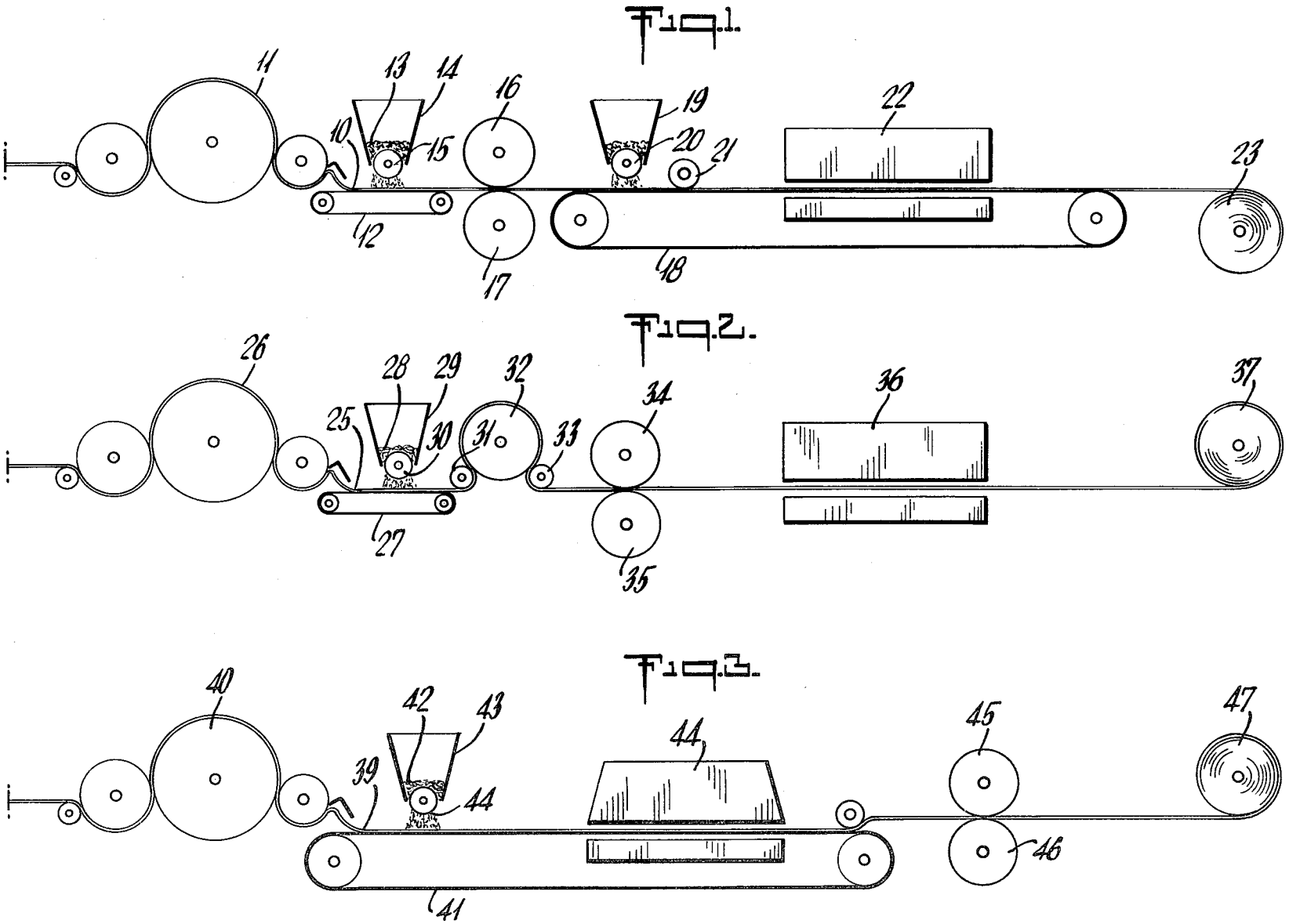
FIG. 1 is a schematic drawing depicting one set of apparatus for carrying out the process of the present invention.
FIG. 2 is a schematic drawing depicting another modification of apparatus for carrying out the process of the present invention.
FIG. 3 is yet another modification of apparatus which may be used in practicing the present invention.

Referring to the drawings, in FIG. 1, there is shown a schematic view of apparatus suitable for carrying out the process of the present invention. In the first step of our new process, a web 10 of fibers is formed from a series of textile cards 11 which lay the fibers down in a uniform, lightweight layer on an endless conveyor 12. Thermoplastic fibers 13 are distributed on the layer of textile fibers. The thermoplastic fibers are fed from a hopper 14 positioned above the fiber layer. A metering roll 15, which is preferably a toothed roll, deposits a uniform amount of thermoplastic fiber on the layer. If desired, the thermoplastic fibers may also be processed through the card along with the textile fibers. The layer of textile fibers with the thermoplastic fibers therein is passed through a pair of calender rolls 16 and 17. The calender rolls are heated to a temperature where the thermoplastic fiber will melt and a pressure of about 50 pounds per lineal inch is applied to the fibrous layer by the calender rolls. The textile fibers within the layer are held in intimate contact by the thermoplastic fibers by this heat and pressure application. The compressed fiber layer is placed on a second endless conveyor 18. A hopper 19 with a metering roll 20 at the discharge end of the hopper is positioned above the compressed fibrous web. The hopper contains a supply of the desired polymerizable binder in solid particle form. The metering roll distributes the desired amount of polymerizable binder on the fibrous web. The fibrous web with the particles thereon is conveyed by the conveyor and slightly further pressed by roll 21. The pressed web is passed through an electron beam radiation apparatus 22 such as that manufactured and sold by Energy Sciences, Inc. of Bedford, Mass. or High Voltage Engineering of Burlington, Mass. The polymer is treated with electron beam radiation to cross-link the polymer and bond the fibers together to produce a strong, durable nonwoven fabric. The bonded fabric is rolled up on a standard wind-up mechanism 23.

Referring to FIG. 2 of the drawings, there is schematically shown another form of apparatus useful in practicing the present invention. A fibrous web 25 is formed from a series of standard cards 26 and deposited on an endless conveyor 27. A polymerizable binder material 28 ("prepolymer"), in particulate form, is applied from hopper 29, by metering roll 30 onto the fibrous web. The web with the binder particles thereon is transferred by roll 31 to the periphery of a heated drum 32. The web is heated, removed from the drum by roll 33 and passed through a pair of calender rolls 34 and 35. The calender rolls heat the prepolymer, soften it and embed the fibers in the prepolymer and place them in intimate contact with each other. The web with the polymer therein is then passed through an ionizing radiation unit 36 to cross-link the polymer and wound up on a standard wind-up mechanism 37.

FIG. 3, schematically shows yet another method for practicing the present invention. A fibrous web 39 is produced by a standard card engine 40 or series of such machines and deposited on an endless conveyor 41. A polymerizable binder material 42, in particulate form, is applied from hopper 43, by metering roll 44 onto the fibrous web. The web with the binder thereon is passed through an ionized radiation unit 44 and immediately thereafter compressed by a set of calender rolls 45 and 46 to embed the fibers in the binder material as it continues its polymerization. The bonded web is wound up on standard wind-up mechanism 47.

The fibers used to form the starting fibrous layers may be any of the natural, artificial or synthetic organic fibers such as cotton fibers, rayon fibers, polyester fibers, polyamide fibers, acrylic fibers, modacrylic fibers, vinal fibers, vinyl chloride fibers and the like, though it is preferred that the fibers be either of the polyester, polyamide or acrylic variety. The fibers should have a length of from about ¼" to 2½" or more and may even be continuous filaments if desired. The fibers usually have a denier of about 1½, though larger denier fibers may also be used.

If desired a portion of wood pulp fibers may be incorporated with the longer fibers or filaments to add absorbency and other desirable properties to the final product and reduce the cost of the product.

The fibrous layer may be formed by carding, air-laying, wet-laying or similar techniques which would dispose the fibers in a plurality of diverse directions within the layer.

The thermoplastic material used to hold the fibers together may be any of the relatively low temperature softening and meltable thermoplastic materials such as the polyolefins; that is, polyethylene and polypropylene, or the low melting polyamides or undrawn polyethylene terephthalate or other lower melting polyesters and the like. Satisfactory results have been obtained when these thermoplastic materials are in the form of fibers and they may be incorporated in the fiber layer either during the carding or air-laying or other formation of the starting layer or they may be deposited on the layer after it has been formed.

It is important that less than about 5 percent by weight of the fiber layer of the thermoplastic material be incorporated therein. Satisfactory results have been obtained using from about 1 percent to 3 percent by weight of the fiber layer of the thermoplastic material. If more than 5 percent of thermoplastic material is used, it tends to interfere with the desired bonding by the ionizing radiation. It is theorized that the higher amounts tend to cover a greater surface area of the web and, in fact, cover a greater number of points where fibers are in intimate contact with each other and hence prevent the desired ionizing radiation polymer from accomplishing its bonding at the most beneficial areas of the web. It is further theorized that this phenomenon is even more acute when trying to prebond the web utilizing liquid prebinders in an attempt to hold the fibers together and place them in a condition for the ionizing radiation treatment. It is believed that the liquid prebinders tend to accumulate at the most desirable bonding areas; that is, the areas where the fibers are in intimate contact and hence even a small amount of liquid prebond will disrupt or undermine the desired bonding by ionizing radiation.

The polymer material to be used as the binder might be better classified as a prepolymer and is an unsaturated polymer having a low softening point. The polymer should soften at a temperature of less than 150° C. and preferably in the range of from about 80° C., to 85° C. Preferably the polymer material will also contain a modest amount of a polyfunctional cross-linking monomer.

The polymer materials that may be used to produce the fabrics of the present invention are the unsaturated polyester polymers, the unsaturated polyurethane polymers, the unsaturated epoxy bis-phenol A acrylate resins, modified silicones, unsaturated acrylate copolymers, and block copolymers of styrene and butadiene.

Suitable unsaturated polyester polymers are those produced by combining acids; such as maleic acid or anhydride, phthalic acid, isophthalic acid, adipic acid and the like, and condensing the acids with a dihydric alcohol; such as ethylene glycol, diethylene glycol, propylene glycol, the butane diols, etc.

Suitable unsaturated polyurethane polymers are those produced by reacting hydroxyl-terminated unsaturated polyesters; such as poly (1,4)-butylene fumarate, with a diisocyanate, such as 2,4-tolylene diisocyanate, diphenyl methane diisocyanate, and the like.

The unsaturated epoxy bis-phenol A resins are those primarily formed by reacting the diglycidyl diether of bisphenol A with an unsaturated carboxylic acid such as maleic acid or acrylic acid to form a suitable unsaturated polymer or prepolymer.

Examples of modified silicone materials are the reaction products of siloxanes or alkoxy silanes (containing silanol functionality) with organic polymers containing hydroxyl groups, such as the incompletely esterified acrylates, epoxys, or the like to provide polymers of the following general formula:

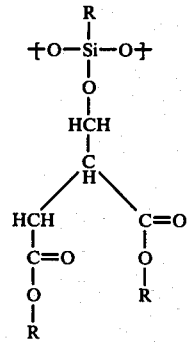

where R is a saturated or unsaturated alkyl group, hydrogen, a halogen or other organic group having less functionality than the base polymer, provided that at least some of the R groups in any such composition must be unsaturated alkyl.

The unsaturated acrylate copolymers which are useful in the present invention are illustrated by poly(ethyl acrylate) which contains a few percent of a polymerized doubly unsaturated comonomer, such as allyl acrylate.

Suitable block copolymers of styrene and butadiene are the materials such as Kraton D sold by the Shell Chemical Company.

As previously mentioned, it is preferred that a polyfunctional cross-linking monomer material be included with the polymer. The monomer material is selected so as not to cross-link merely on the application of heat but to readily cross-link on the application of irradiation. The amount used may be varied depending on the properties of the monomer selected and its functionality but generally amounts of less than 10 percent by weight of the fiber of the polymer material have been found suitable. Preferred monomer materials are the solid or highly viscous acrylates. Specific monomers are pentaerythritol triacrylate, ethoxylated bisphenol A dimethacrylate, dipentaerythritol monohydroxypenta-acrylate, pentaerythritol tetracrylate, pentaerythritol tetramethacrylate, triallyl cyanurate, diallyl melamine, diallyl maleate, divinylbenzene, and the like.

Critical properties of the polymer or combination of polymer and monomer materials used in the present invention are that the material should soften at 150° C. or less, and have a melting point not much higher than 160° C. to 180° C. The polymer should also contain unsaturation sites which are susceptible to cross-linking when subject to radiation energy. Also, the material should be extrudable or castable or in such form as to allow for processing of the material into the size called for by the present invention.

When choosing a specific monomer material to be used in accordance with the present invention, consideration should be given to the melting temperature of the monomer so that the resultant monomer-polymer mixture still meets the melting and softening parameters previously described. The partial vapor pressure of the monomer should be relatively low so that it is not removed when extruded or cast or the subsequent fabric heated prior to irradiation. The monomer should also be compatible with the polymer to simplify the mixing of the materials.

It has also been found helpful to incorporate with the polymer or a polymer-monomer mixture a small amount of the commercially available polymerization inhibitors such as hydroquinone. These materials provide the polymer with greater "shelf-life" and reduce the problem of undesired polymerization when the polymer is subjected to some heat as in extrusion or casting processes.

The polymer or polymer-monomer mixture may be extrudable.

The polymer or prepolymer and monomer materials previously described may be applied to the web either in solid form or liquid form as desired. Specific techniques for applying them are known in the art.

These binders are then cross-linked with electron beam radiation. The radiation used should preferably have a wave length of from 0.001 Angstrom to 1 Angstrom with a frequency of $10^{18}$ cycles per second to $10^{21}$ cycles per second and with an energy of from $10^4$ electron volts to $10^7$ electron volts. Suitable radiation sources are the high energy electron beam radiation units manufactured by Energy Sciences, Inc. of Bedford, Mass. and High Voltage Engineering of Burlington, Mass. The radiation dosage applied to the web and polymer particles is preferably from 3 to 8 megarads.

The type and amount of radiation is important. The electron beam radiation eliminates the shadow effect which is often given with other types of radiation. That is, the fibers at the bottom of the web or the surface furthest disposed from the radiation source are protected by the shadows of the fibers above them. When this happens, the degree of bonding or amount of adhesion will decrease as you move from the surface of the web closest to the source to the opposite surface. We have not seen this type of phenomenon using electron beam radiation within the ranges described above, but have noted good uniformity of degree of bonding from one surface of the web to the opposite surface.

An additional embodiment of the present invention is a two step irradiation process. The polymerizable binder materials, as previously described, are applied to the starting web and the web with the binder materials thereon treated with electron beam radiation at a low dosage of 0.1 to 1 megarad. The treated web is compressed by passing it through a pair of calendering rolls or other well known compression techniques and the compressed web given a second electron beam radiation treatment in accordance with the parameters hereinbefore described.

It is important during the irradiation step to exclude oxygen from the irradiation zone to obtain more efficient and complete polymerization and bonding of fibers in the web. This may be accomplished quite readily by carrying out the irradiation in an atmosphere of nitrogen or other inert gas.

The following examples are illustrative of the method of the present invention.

EXAMPLE 1

A web of polyester fibers, 1½ denier and 2 inches in length, and weighing about 600 grains per square yard is formed by a plurality of cards. In the carding operation approximately 3 percent by weight of a polyethylene fiber approximately ¾" in length and 1½ denier is uniformly deposited throughout the polyester fiber. The web containing the polyethylene fibers is subjected to heat and pressure to fuse and embed fibers in the polyethylene fibers.

The prepolymer to be used in bonding the web is produced by charging 928 grams of cyclohexane diol and 464 grams of maleic acid in a three liter vacuum reactor and polymerizing. Water is removed to an acid number of 40. The resultant polymer is removed from the reactor and allowed to cool. 600 Grams of the polymer is blended with 108 grams of sodium methacrylate to produce a mixed solid. About 35 grams of pentaerythritol triacrylate and 100 parts per million of a hydroquinone stabilizer is added to the mixed solid. The mixture is extruded into 15 denier monofilaments which are cut about six millimeters in length. The filaments are dispersed in the polyethylene bonded polyester web. About 20 grains of the filaments are dispersed per square yard of web. The web is exposed to an electron beam radiation at a dosage of about eight megarads to further polymerize and cross-link the polymer. The resultant fabric is resistant to solvents in water and has excellent dry and wet tensile strengths.

EXAMPLE 2

A web of polyester fibers, 1½ denier and 2 inches in length, and weighing about 600 grains per square yard is formed by a plurality of cards.

The prepolymer used to bond the web is an unsaturated epoxy bis-phenol A acrylate. The prepolymer is dissolved in acetone to a concentration of about 10 percent. The prepolymer-acetone solution is applied to the web using a standard mangle operation and the web picks up about 200 percent by weight of the web of the solution.

The acetone is evaporated from the web by standard techniques and the web passed between a pair of calendar rolls that apply a pressure of about 50 pounds per lineal inch to the web.

The compressed web is exposed to electron beam radiation at a dosage of eight megarads to polymerize and cross-link the unsaturated epoxy bis-phenol A acrylate. A strong, washable and durable nonwoven fabric is attained.

Having now described the invention in specific detail and exemplified the manner in which it may be carried into practice, it will be readily apparent to those skilled in the art that innumerable variations, modifications, applications and extensions of the basic principles involved may be made without departing from the spirit and scope. We intend to be limited, therefore, only in accordance with the appended patent claims.

What is claimed is:

1. A method of manufacturing a bonded nonwoven fabric comprising; forming a layer of organic fibrous material, incorporating in said layer up to 5 percent by weight of the layer of a thermoplastic fiber, heating and compressing said layer of fibrous material with said thermoplastic fiber material incorporated therein to provide intimate contact between the fibers, applying a polymerizable binder material to said compressed fiber layer and treating said compressed fiber layer with the binder material thereon with ionizing radiation to polymerize the binder material and adhere the fibers together to produce a strong nonwoven fabric, provided that while said compressed fiber layer is being treated with said ionizing radiation, no mechanical means are employed to compress said fiber layer to provide intimate contact between the fibers, said bonded nonwoven fabric being capable of being rolled up on a standard wind up mechanism.

2. A method according to claim 1 wherein the thermoplastic fiber is a polyolefin fiber and the layer is heated during said heating and compressing step to a temperature to soften and melt said polyolefin fiber.

3. A method according to claim 2 wherein from about 1 percent to 3 percent by weight of the layer of a polyolefin fiber is incorporated in the layer.

4. A method according to claim 1 wherein the ionizing radiation is electron beam radiation having a wave length of less than 1 Angstrom and a frequency of at least $10^{18}$ cycles per second.

5. A method according to claim 4 wherein the thermoplastic fiber is a polyolefin fiber and the layer is heated during said heating and compressing step to a temperature to soften and melt said polyolefin fiber.

6. A method of manufacturing a bonded nonwoven fabric comprising; forming a layer of organic fibrous material, applying a polymerizable binder material to said layer, heating and compressing said layer with the binder material thereon to provide intimate contact between fibers in the layer, and treating said compressed fiber layer with the binder material thereon with ionizing radiation to polymerize the binder material and adhere the fibers together to produce a strong nonwoven fabric, provided that while said compressed fiber layer is being treated with said ionizing radiation, no mechanical means are employed to compress said fiber layer to provide intimate contact between the fibers, said bonded nonwoven fabric being capable of being rolled up on a standard wind up mechanism.

7. A method according to claim 6 wherein the ionizing radiation is electron beam radiation having a wave length of less than 1 Angstrom and a frequency of at least $10^{18}$ cycles per second.

8. A method of manufacturing a bonded nonwoven fabric comprising; forming a layer of organic fibrous material, applying a polymerizable binder material to said layer, treating said layer with the binder material thereon with ionizing radiation to begin polymerization of the binder material, and compressing said treated layer to provide intimate contact between the fibers while the binder material is still polymerizing and adhere the fibers together to produce a strong nonwoven fabric, provided that while said layer is being treated with ionizing radiation, no mechanical means are employed to compress said layer to provide intimate contact between the fibers, said bonded nonwoven fabric being capable of being rolled up on a standard wind up mechanism.

9. A method according to claim 8 wherein the ionizing radiation is electron beam radiation having a wave length of less than 1 Angstrom and a frequency of at least $10^{18}$ cycles per second.

* * * * *